United States Patent [19]

Guard

[11] 3,980,516

[45] Sept. 14, 1976

[54] SIDE WELD PLASTIC BAG MANUFACTURING MACHINE

[76] Inventor: Twyman Guard, 795 S. Alten Way, Denver, Colo. 80210

[22] Filed: Nov. 18, 1974

[21] Appl. No.: 524,630

[52] U.S. Cl. ..... 156/515; 83/324; 93/8 R; 93/33 H; 93/DIG. 1; 156/583

[51] Int. Cl.[2] ..... B31B 21/14; B31B 21/60

[58] Field of Search ..... 156/515, 583, 510, 582, 156/251; 93/33 H, 33 R, 8 R, DIG. 1; 83/324

[56] References Cited

UNITED STATES PATENTS

| | | | |
|---|---|---|---|
| 2,933,023 | 4/1960 | Weber | 93/8 R |
| 3,451,870 | 6/1969 | Pearson | 156/515 |
| 3,743,562 | 7/1973 | Phipps | 156/583 |
| 3,755,041 | 8/1973 | Membrino | 156/515 |
| 3,793,927 | 2/1974 | Emond | 156/515 |

*Primary Examiner*—William A. Powell
*Assistant Examiner*—M. G. Wityshyn

[57] ABSTRACT

The disclosure relates to a side weld plastic bag manufacturing machine. The machine having a pair of drive rollers adapted to drive folded plastic toward a heat seal roller and a heat seal bar which is continuously rotated to engage the folded plastic and to seal at spaced positions. Means is provided to operate the heat seal bar and the heat seal roller at a rate common to that of the drive rollers, and further means is provided for quickly rotationally advancing the heat seal bar and the seal roller at a higher rotational rate than the drive rollers to separate the plastic at its welded portion from the surface of the heat seal roller while held between the drive rollers. The mechanism used to accomplish the common rate driving and the higher rate driving of the seal roller and heat seal bar comprising an overrunning clutch and lost motion mechanism coupled to the sealer roller and an arm coupled to the heat seal bar adapted to operate the overrunning clutch to coordinate and advance the sealing roller at a higher rate when the heat seal bar is operated at a higher rate by intermittently operable clutch means and a variable ratio gear train mechanism.

11 Claims, 16 Drawing Figures

SIDE WELD PLASTIC BAG MANUFACTURING MACHINE

BACKGROUND OF THE INVENTION

Various machines have been used for manufacturing plastic bags from folded plastic material so as to accomplish side welds spaced apart, and in the operation of such machines it has been necessary to cause the mechanism to separate a side welded area of a heat sealed bag from the oncoming folded plastic material so as to deliver the sealed bag and to separate it from the heat sealing roller during continuous or intermittent feed of the plastic through such machines. Some of the prior art machines drive the plastic intermittently and use various means for separating the heat-sealed bag and the oncoming plastic from the heat seal roller while the plastic is fed from a roll of plastic toward the heat sealing mechanism of such machines. Due to the various intermittent operations of prior art machines as well as the starting and stopping of various heat sealing and separating mechanisms, such prior art machines have been unduly limited in rate of production so that the number of bags per minute that can be produced has been the principal problem of operation.

SUMMARY OF THE INVENTION

The present invention relates to a plastic bag manufacturing machine which include drive rollers adapted to drive folded plastic toward a sealer roller and heat seal bar and the machine of the invention operates continuously without interrupting the linear flow rate of the folded plastic through the machine, and a heat seal bar and sealer roller operate at a common rate initially to engage and seal the plastic and then are quickly accelerated for a few degrees in a rotational direction to separate the heat seal roller from the sealed bag and from the oncoming folded plastic and this occurs during each rotational cycle of the heat seal bar which cycle rate may be varied in order to provide for the production of bags of varying widths. When the plastic is heat sealed against the periphery of the sealer roller by the heat seal bar the plastic tends to stick to the periphery of the sealer roller and consequently it is necessary rapidly to advance the periphery of the sealer roller to separate it from the sealed edge of the oncoming plastic so as to prevent the plastic from sticking to the sealer roller and wrapping therearound.

The mechanism of the invention for quickly advancing the heat seal bar and seal roller after the heat seal is made comprises an overrunning clutch on the heat seal roller and an arm on the heat seal bar which engages the overrunning clutch and advances the seal roller while lost motion mechanism between its primary drive and its shaft permits the roller to be advanced a few degrees very quickly by the overrunning or one-way clutch in unison with a relatively high rate of the operation of the heat seal bar as compared to that of the feed or drive rollers which deliver the plastic to the sealer and heat seal bar.

In accordance with the foregoing folded plastic moves through the machine at a constant rate without interruption and the heat seal bar rotates intermittently at a cycle rate to determine the width of each bag being made, and the heat seal bar is operable by a gear train mechanism with a pair of clutches adapted selectively to operate the heat seal bar first at a common rate with that of the drive rollers and, secondarily, at a higher rate in order to provide for separation of the heat seal roller from the sealed bag and from the oncoming folded plastic, and during each revolution of the heat seal bar an arm thereon engages an overrunning clutch for quickly advancing the cooperating sealer roller at said higher rate in unison with that of the heat seal bar. The overrunning or one-way clutch is provided with a stop operable on the frame of the machine to stop it while a return spring returns it to a position such that it is in a starting location adapted to be again engaged by the arm on the heat seal bar for quickly advancing the heat seal roller with the seal bar at a rate higher than that of the oncoming plastic through the machine as controlled by the drive rollers and the advanced or higher rate occurs for only a few degrees of rotation whereupon lost motion mechanism again resumes the driving of said sealer roller at a rate common to that of the drive roller delivering the plastic thereto.

In the mechanism which controls the cycle operation of the heat seal bar, a primary shaft and a jack shaft are utilized with a pair of variable ration gear trains, each operated by an electric clutch which are concurrently operated to switch from a common ratio for the heat seal bar relative to the sealer roller and to a relatively high rate so that the heat seal bar and seal roller may be advanced quickly for a few degrees to cause separation of the heat seal roller from the sealed bag and from the oncoming plastic. Coupled to the gear train is a brake which is operable in unison with the aforementioned clutches in order to stop precisely the rotational disposition of the heat seal bar in a location to resume rotation for the next cycle of operation.

Receiving rolls are disposed downstream from the heat seal bar and sealing roller opposite to that from the drive rollers so as to receive plastic bags which have been heat sealed and delivered from the heat seal roller and heat seal bar. And the receiving rollers are adapted to operate at a higher speed in order quickly to remove the bags from the area as they are delivered during separation at a rate substantially higher than that of the plastic drive roller which deliver the folded plastic to the heat seal bar and the sealer roller.

In accordance with the foregoing it will be appreciated that the machine of the invention may operate at a very high rate with folded plastic material traveling constantly and with the sealer roller and heat seal bar alternately operating at a common rate to that of the drive rollers and intermittently for a few degrees, at a higher rate to separate the heat seal roller from the heat sealed plastic bag and from the oncoming folded plastic.

Accordingly, it is an object of the present invention to provide a plastic bag manufacturing machine adapted to produce bags from folded plastic by the usual side weld process at an extremely high rate for producing a great number of bags in a given length of time.

Another object of the invention is to provide a novel means for operating the heat seal bar and the sealer roller at a rate common to that of the plastic drive rollers, and alternately to advance both the heat seal bar and the sealer roller at a high rate for a few degrees of rotation for quickly separating the heat seal roller from the sealed bag and from the oncoming folded plastic after the heat seal bar has made the seal.

Another object of the invention is to provide a novel dual ration drive train for the heat seal bar of the machine, together with a pair of selective clutches and an electric brake which may be operated in unison and sequence with each other to control the shifting of the ratios of operational speed of the heat seal bar as well as its cycle rate.

Another object of the invention is to provide a novel means for operating the heat seal roller in unison with the heat seal bar at a higher rate than the common rate of the plastic drive rollers for a few degrees of rotational operation to separate the heat seal roller from plastic bags which have been sealed from the oncoming folded plastic.

Another object of the invention is to provide a novel overrunning or one-way clutch mechanism on the shaft of the heat seal roller operable by an arm on the heat seal bar so that the arm engages the one-way clutch and allows the clutch to actuate a lost motion mechanism to overrun the constant drive which drives the seal roller for a few degrees during the separation of the heat seal roller from a sealed bag and from the oncoming plastic delivered by the drive rollers.

Another object of the invention is to provide a novel means for utilizing a one-way or overrunning clutch with a return spring and a stop cooperable with the frame of the machine precisely to reset the clutch so that it is ready again to advance the operation of the sealer roller as an arm from the heat bar engages means to rotate teh overrunning clutch for a few degrees of rotation to concurrently rotate the sealer roller in unison with the heat seal bar at a higher rate than that of the drive rollers which deliver the folded plastic to the area of the heat seal bar and the sealer roller.

Further objects and advantages of the invention may be apparent from the following specification, appended claims and accompanying drawings.

DESCRIPTION OF THE PREFERRED EMBODIMENTS

Figure 1:
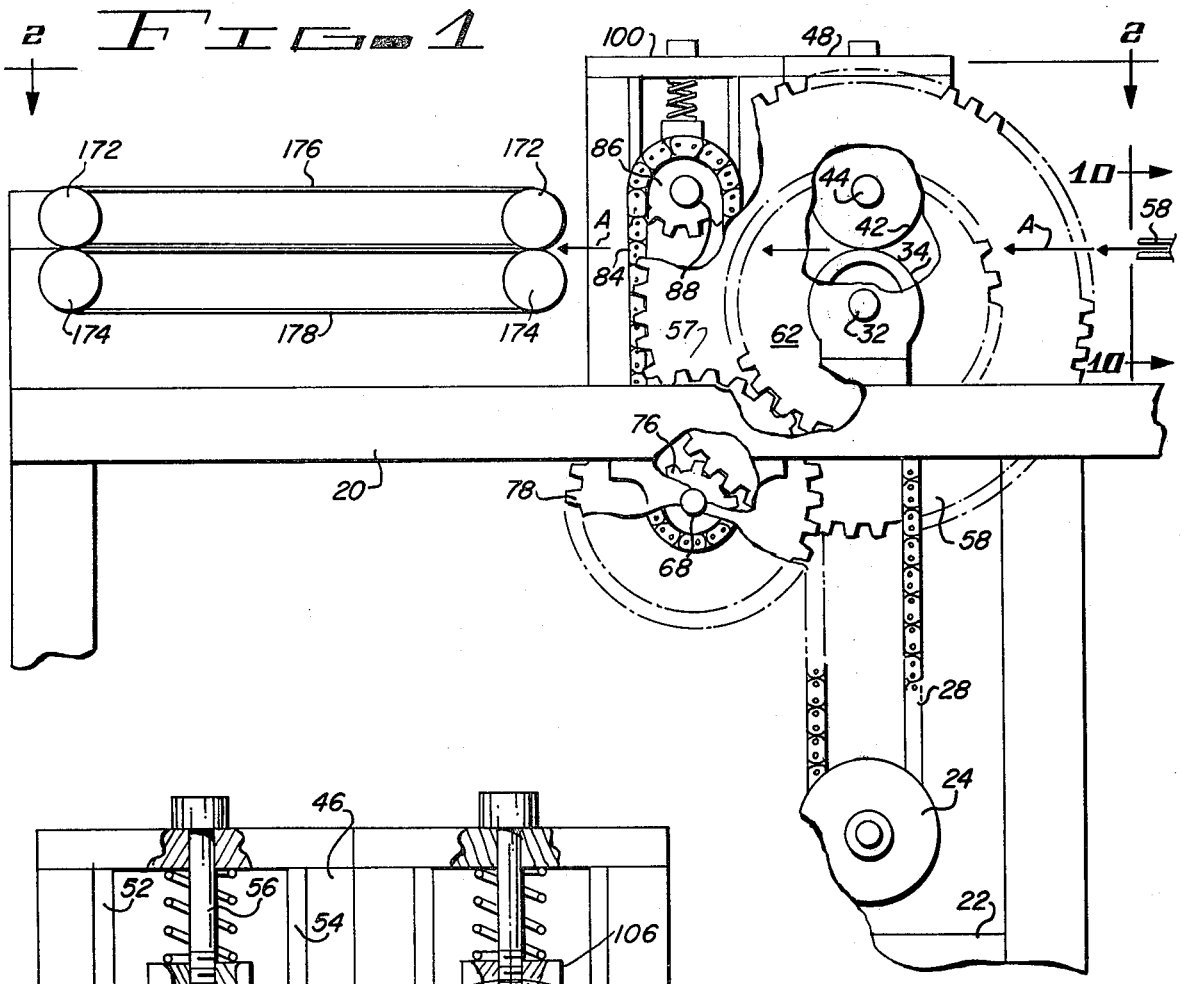
FIG. 1 is a fragmentary side elevational view of a plastic bag manufacturing machine in accordance with the invention and showing portions broken away to amplify the illustration.

As shown in the several views of the drawings, the machine of the invention is provided with a frame 20. This frame 20 is provided with cross members 22 shown best in FIGS. 1 and 3 of the drawings, which support a motor 24 driving a sprocket 26 engaged by a chain 28 which passes over a sprocket 30, shown best in FIGS. 2 and 4 of the drawings. This sprocket 30 is fixed to a shaft 32, which carries and drives a drive roller 34 and fixed to the shaft 32 is a gear 36 meshing with a gear 38 fixed on a shaft 40 which carries and drives a drive roller 42 having its periphery contiguous with the periphery of the drive roller 34 for driving plastic as shown best in FIGS. 1 and 10 of the drawings, in the direction of arrows A shown in FIG. 1 of the drawings. The shafts 32 and 44 are mounted in bearing support frames 46 and 48 as shown in FIG. 2 of the drawings, and on an enlarged scale, in FIG. 4 of the drawings. The frame 46 is shown in detail and in this frame 46 the shaft 32 is mounted stationarily while the shaft 44 is vertically adjustable by means of a vertically movable pillow block 50 operable on slideways 52 and 54 with spring loaded adjustment means 56 adapted to cause the periphery of the roller 42 to bear against the periphery of the roller 34 in order to provide suitable friction for driving the plastic 58 shown in FIG. 1 and 10 of the drawings. The adjustable mounting means 56 may be a spring loaded and screw threaded means so that precise adjustment and tension of the plastic drive means may be accomplished.

The bearing mounts 46 and 48 are similar so that the shaft 32 near opposite ends of the drive roller 42 are supported similarly.

Figure 2:
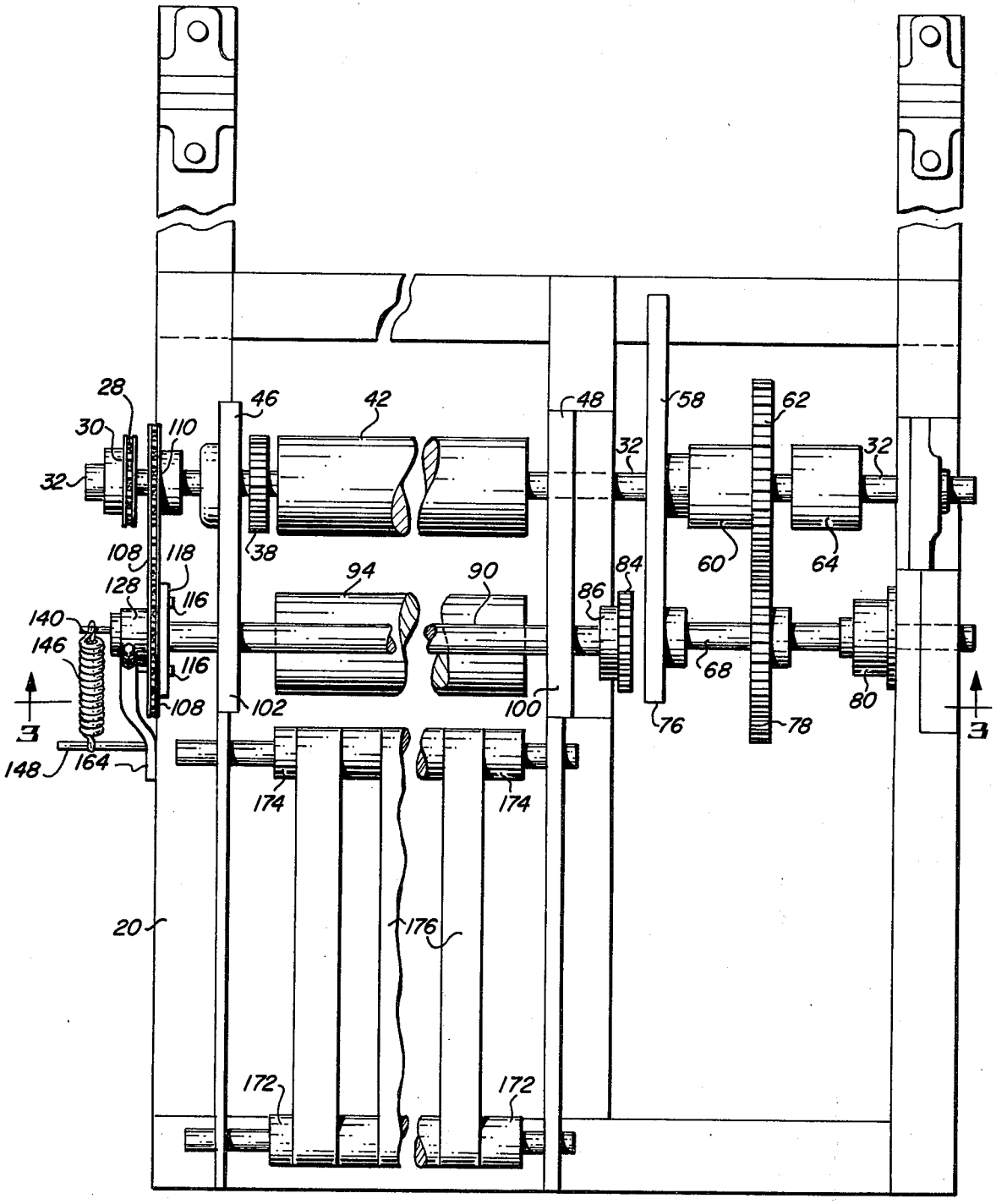
FIG. 2 is a fragmentary top or plan view taken from the line 2—2 of FIG. 1.
Figure 3:
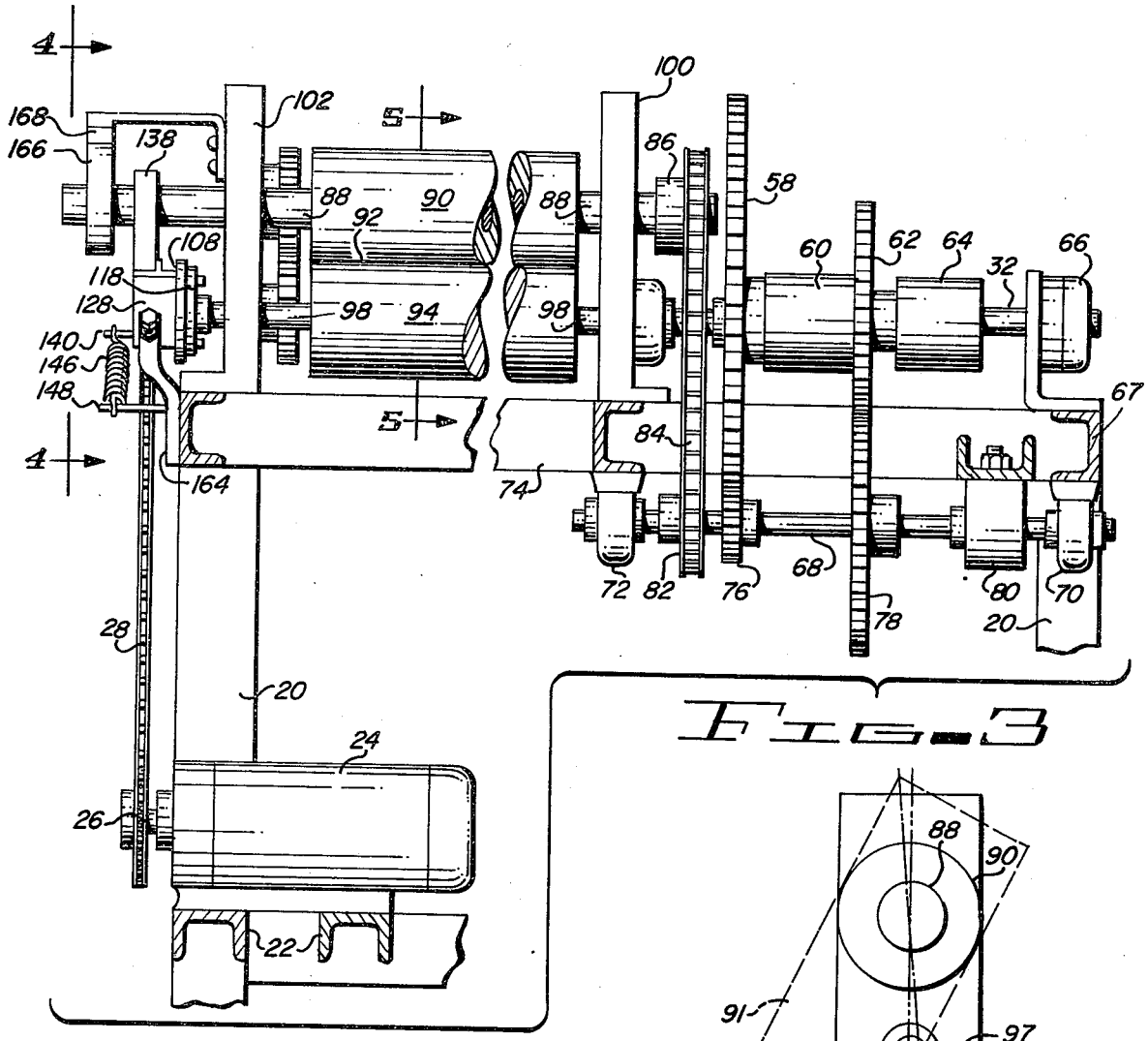
FIG. 3 is a fragmentary sectional view taken from the line 3—3 of FIG. 2.

The shaft 32, as shown in FIGS. 1, 2 and 3, carries a large diameter. gear 57 and this gear 57 is engagable with the shaft 32 by means of an electric clutch 60. The shaft 32 also carries a one-to-one ratio gear 62 which may be coupled to the shaft 32 by means of a clutch 64. This is also an electric clutch similar to the electric clutch 60.

The shaft 32 at its outboard end is carried by a bearing 66 supported on a horizontal portion 67 of the frame 20.

A jack shaft 68 is mounted in spaced relation to the shaft 32 in bearings 70 and 72 which are secured to the horizontal structure 74 of the frame 20.

The jack shaft 68 carries a small spur gear 76 meshing with the large diameter spur gear 57 and the jack shaft 68 also carries another one-to-one ration gear 78 meshing with the one-to-one ration gear 62. The gear 78 being fixed to the shaft and the gear 76 is also fixed to the shaft 68.

An electric brake 80 is disposed to stop and also release the shaft 68 for operation as will be hereinafter described.

Figure 5:
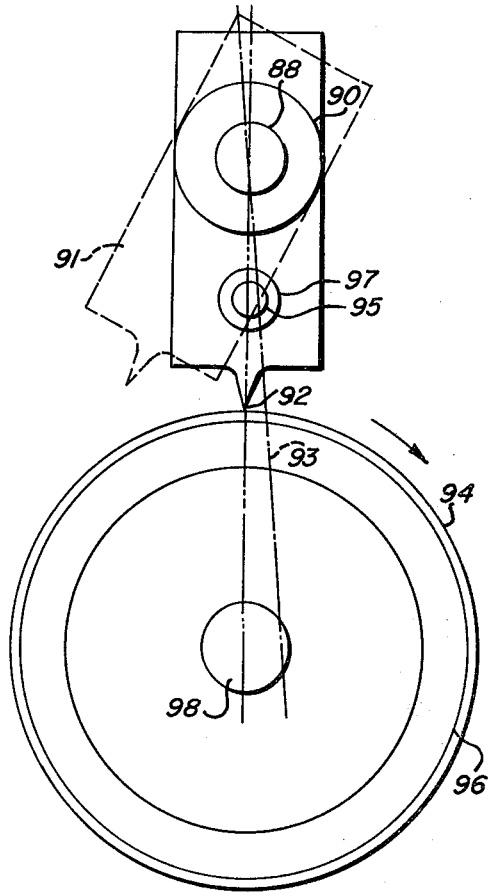
FIG. 5 is an enlarged fragmentary sectional view taken from the line 5—5 of FIG. 3.

Mounted on the shaft 68 is a sprocket 82 driving a chain 84 which passes over a sprocket 86 on a shaft 88 of a heat seal bar 90. This heat seal bar 90 as shown in FIGS. 3 and 5 is provided with a heat sealing edge 92 which is electrically heated by means of an electrical heating element 95 in an opening 97 which extends longitudinally of the heat seal bar 90.

The heat seal edge 92 is adapted to operate in contiguous relation with the periphery 94 of the heat seal roller 96 which is carried by a shaft 98 supported at one end in a bearing frame 100 adjacent to the bearing frame 48 hereinbefore described. The shaft 98 near its other end is supported in a bearing frame 102 near the bearing frame 46 hereinbefore described. The bearing frame 102, as shown in FIG. 4 of the drawings, is similar to the bearing frame 52 and carries and adjustable bearing 104 supporting the heat seal bar shaft 88, an adjustable mount 106 is adapted to provide for adjustment tension of the shaft 88 relative to the periphery 94 of the seal roller 96.

The adjustment means 106 is similar to the adjustment means 56 and permits adjustment of the axis of the heat seal bar 88 so that its heat seal edge 92 may be adjusted into close proximity to the periphery 94 of the heat seal roller 96.

Figure 4:
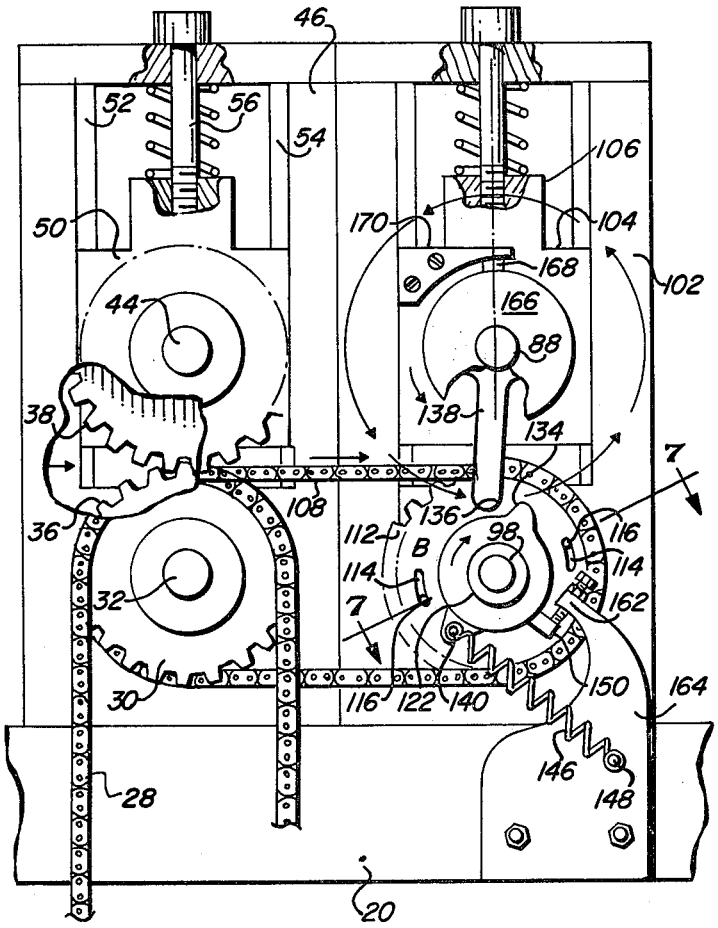
FIG. 4 is an enlarged fragmentary side elevational view taken from the line 4—4 of FIG. 3 showing the opposite side of the machine from that as shown in FIG. 1 of the drawings.

The roller 96 is driven by the shaft 98 and the shaft 98 is driven by a chain 108, shown best in FIGS. 2, 3 and 4 of the drawings. This chain 108 engages a sprocket 110 on the shaft 32 and also engages a sprocket 112 on the shaft 98 which carries the sealer roller 96. The sprocket 112 is provided with a plurality of arcuate lost motion slots 114 therein. These slots 114 receive pins 116 of a lost motion mechanism. The pins 116 in the slots 114 constitute the lost motion mechanism and the pins 116 are carried by and fixed to a flange member 118, shown best in FIGS. 3 and 7 of the drawings. This flange member 118 is fixed to the shaft 98 by means of a key 120. The pins 116 extend through the arcuate slots 114 and this allows the shaft 98, together with the flange 118 and pins 116 to operate for a few degrees independently of the sprocket 112 and to thereby rotate in the direction of the arrow B as shown best in FIG. 4 of the drawings. This operational function will be hereinafter described in relation to the separation of a welded plastic bag from the oncoming plastic delivered by the drive rollers 42 and 34.

Figure 7:
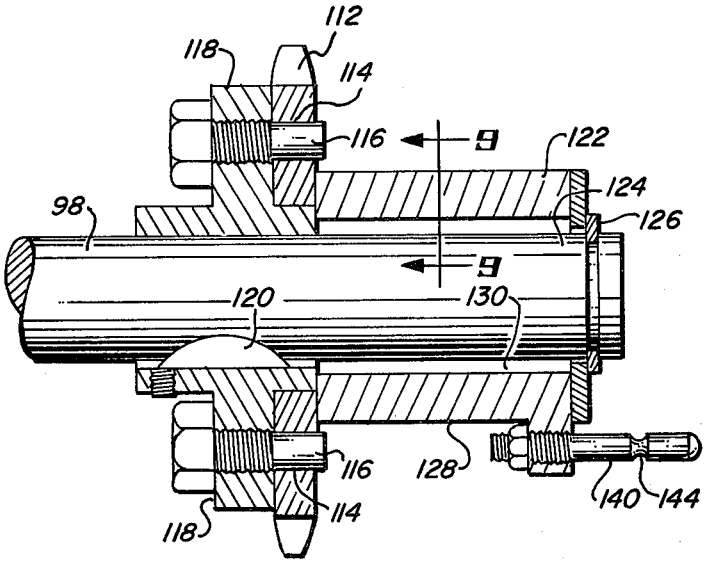
FIG. 7 is an enlarged fragmentary sectional view taken from the line 7—7 of FIG. 4.

As shown in FIGS. 4 and 7, a one-way clutch 122 commonly known as an overrunning or spragg clutch, is mounted on an outboard end 124 of the shaft 98 and retained thereon by conventional snap ring 126. The overrunning clutch is provided with an outer housing portion 128 and spraggs 130, all as shown best in FIGS. 7 and 9 of the drawings. The peripheral portion 124 of the shaft 98 is engaged by the roller spraggs 130 and conventional ramp type abutments 132 on the inner surface of the clutch frame 128 cause cam locking action of the member 128 relative to the shaft 98 for locking the clutch on the shaft and causing rotation of the shaft as will be hereinafter described.

The outer housing structure 122 of the overrunning clutch is provided with an extending pawl 134 shown in FIG. 4 of the drawings, and this pawl is engagable by an end portion 136 of an advancing member 138 which is fixed to the shaft 88 of the heat seal bar 90.

Figure 8:
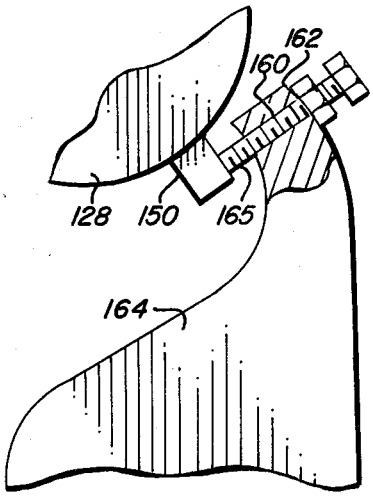
FIG. 8 is an enlarged fragmentary view similar to FIG. 4, but showing only a portion of the mechanism thereof, particularly stop mechanims for the one-way clutch of the invention.

The portion 136 of the advancing member 138 engages the pawl portion 134 and operates the one-way clutch in the direction of the arrow B causing the shaft 98 to be rotated in that same direction and at that time the pins 116 transverse the arcuate slots 114 at a higher rate than the rotational speed of the sprocket 112 until the end portion 136 of the advancing member 138 clears the pawl 134. It will be seen that the one-way clutch 122 at the periphery of its housing portion 128 carries an extending pin 140 having a groove 144 engaged by an end of a spring 146 anchored to the frame by a pin 148. The spring tends to return the one-way clutch 122 at its stop portion 150 in engagement with an adjusting screw 160 carried by an end portion 162 of the bracket 164 mounted on the frame 20. Details of the bracket and adjusting screw are shown in FIG. 8. The stop 150 may be adjusted by means of the end 165 of the adjusting screw 160 in order to adjust the starting location of the one-way clutch 122 so that its pawl 134 may be disposed to be engaged by the portion 136 of the advancing member 138 in relation to the edge 92 of the heat seal bar 90 as shown best in FIG. 5 of the drawings. It will be seen that the heat seal bar as shown in broken lines 91 in FIG. 5 of the drawings may represent a starting position of the heat seal bar and when its cycle of operation begins it rotates to a solid line position shown in FIG. 5, at which point it seals the opposite sides of the plastic 58 together whereupon the end portion 136 of the advancing member 138 engages the pawl 134 and moves the edge 92 to a broken line position 93 shown in FIG. 5. This also being illustrated in FIG. 6 with the plastic 58 in position. The plastic having been sealed at 59 is separated when the edge 92 of the heat seal bar is moved to the position 93 which is only a few degrees in advance of the operation of the sealer roller 94. Thus the one-way clutch is adapted to be actuated by the heat seal bar 90 to rotate the heat seal roller 94 a few degrees from the line passing through the center of the sealer roller 94 to the line 93 hereinbefore described.

Figure 6:
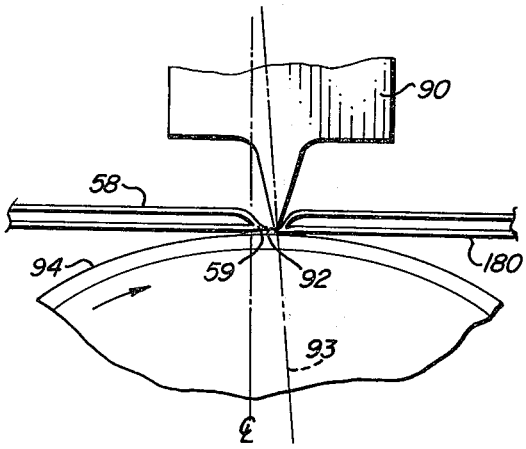
FIG. 6 is a diagramatic view of the plastic bags separating function accomplished by the structure as shown in FIG. 5.

It will be appreciated that the sealed end 59 of the plastic 58 as shown in FIG. 6 tends to stick to the periphery 94 of the heat seal roller when it is heat sealed by the heat seal edge 92 of the heat seal bar 90. Accordingly, rapid advancement of the periphery 94 of the heat seal roller in a direction of the arrow in FIG. 6 of the drawings causes the periphery of the sealer roller to pull away from the edge 59 to thereby allow it freedom to pass onward into a position between the take-out rollers 172 and 174 and thus the edge 59 of the plastic 58 is prevented from sticking to the periphery 94 of the sealer roller and is thus prevented from wrapping around the sealer roller all as shown best in FIGS. 1 and 6 of the drawings.

The shaft 88 of the heat seal bar carries a slip ring 166 engaged by a brush 168 mounted on a bracket 170 so that electrical energy may be conducted to the heating element 95 as shown in FIG. 5 of the drawings.

Two pairs of rollers, designated 172 and 174 are shown in FIGS. 1 and 2 of the drawings and these rollers carry respective belts 176 and 178 in close proximity to each other. Plastic, as indicated by the arrow A in FIG. 1 of the drawings, is adapted to be received between the belts 176 and 178 and this plastic is the plastic bag designated 180 in FIG. 6 of the drawings which has been separated from the oncoming plastic 58 shown in FIG. 6. These rollers 172 and 174 are adapted to operate at a higher rate than the common feed rate of the drive rollers 42 and 34 and the common rate of the sealer roller 94.

Thus, the rollers and belts shown in FIG. 1 of the drawings remove plastic bags which have been sealed and separated and clear them from the area of the heat seal bar edge 92 and the periphery 94 of the sealer roller.

In operation of the motor 24 operates the entire mechanism hereinbefore described, and the magnetic clutches 60 and 64 together with the brake 80 are cycled in order to operate the heat seal bar from its starting position 91, as shown in FIG. 5, a full rotation and back to the starting position 91. The heat seal bar cycle is first initiated by energizing the clutch 64 which operates the one-to-one gear 62 and 78 moving the seal bar edge 92 onto and engagement with the periphery of the sealer roller 94 at the same rotational rate and common to the rate of the drive rollers 42 and 43.

After the plastic material has been side welded, as shown in FIG. 6, the magnetic clutch 64 is de-energized and the magnetic clutch 60 is concurrently energized which changes the gear ration from one-to-one to the jack shaft 68 to a much higher ratio due to the different size of the gear 58 relative to the gear 76. This causes a rapid increase in speed or rotational rate of the heat seal bar and thereby causes the advancing member 138 at its engaging portion 136 to engage the pawl 134 of the one-way clutch as hereinbefore described for rapidly advancing the periphery of the seal roller and the edge 92 of the heat seal bar as shown sin FIG. 6, and thereby moving the heat seal bar and sealer roller at a rapid rate for a few degrees to separate the heat seal roller from the oncoming folded plastic 58 being delivered from the drive rollers 34 and 42 and thus preventing the oncoming folded plastic from sticking to the periphery of the heat seal roller and becoming wrapped therearound.

It will therefore be appreciated that the clutches 64 and 60 are concurrently de-energized and energized respectively to change gears and to change the ratio of drive speed for the heat seal bar and thereby increase its rate very rapidly, at which time the advancing member 138 operates the overrunning or one-way clutch to advance the rotational rate of the shaft 98 carrying the sealer roller 94. Accordingly, the heat seal bar and the sealer roller 94 operate at a common rate with the drive rollers 34 and 42 during the heat seal and welding operation being performed on the plastic, and then the drive and clutch mechanism functions rapidly to increase the rate of the heat seal bar and the sealer roller for the separating operation as shown in FIG. 6 of the drawings.

It will be seen, as shown in FIG. 4, that the one-way clutch is always returned to its starting position by the spring 146 forcing the stop 150 into engagment with the stop screw 160 hereinbefore described, so that each cycle of operation is preceded by a resetting of the one-way clutch so that is is again ready to rotate the sealer roller at a higher rate than the common rate hereinbefore referred to as the portion 136 of the advancing member 138 is engaged with the pawl 134 by operation of the heat seal bar at a higher rate than the common drive rate of the drive rollers 34 and 42.

It will be understood that the sprocket 112 is always rotating at the common rate while the pins 116 in the slots 114 operate at said higher rate and therefore the slots are relatively short as compared to the distance which the pawl 134 travels since the sprocket 112 is operating in the same direction at the common rate while the pins are operating at a higher rate thus allowing the end 136 of the advancing member to clear the pawl 134 and to permit the one-way clutch to return to its stop position as is shown in FIG. 8 of the drawings.

Following this the sprocket 112 continues to operate at the common rate and gradually proceeds in the driving direction until the pins 116 are engaged in the ends of the slots 114 as shown in FIG. 4 of the drawings, at which time the sealer roller is again operated at the common rate with the drive rollers 34 and 42.

In the modification as shown in FIGS. 11 to 14 inclusive, similar parts are designated by similar reference characters.

Figure 11:
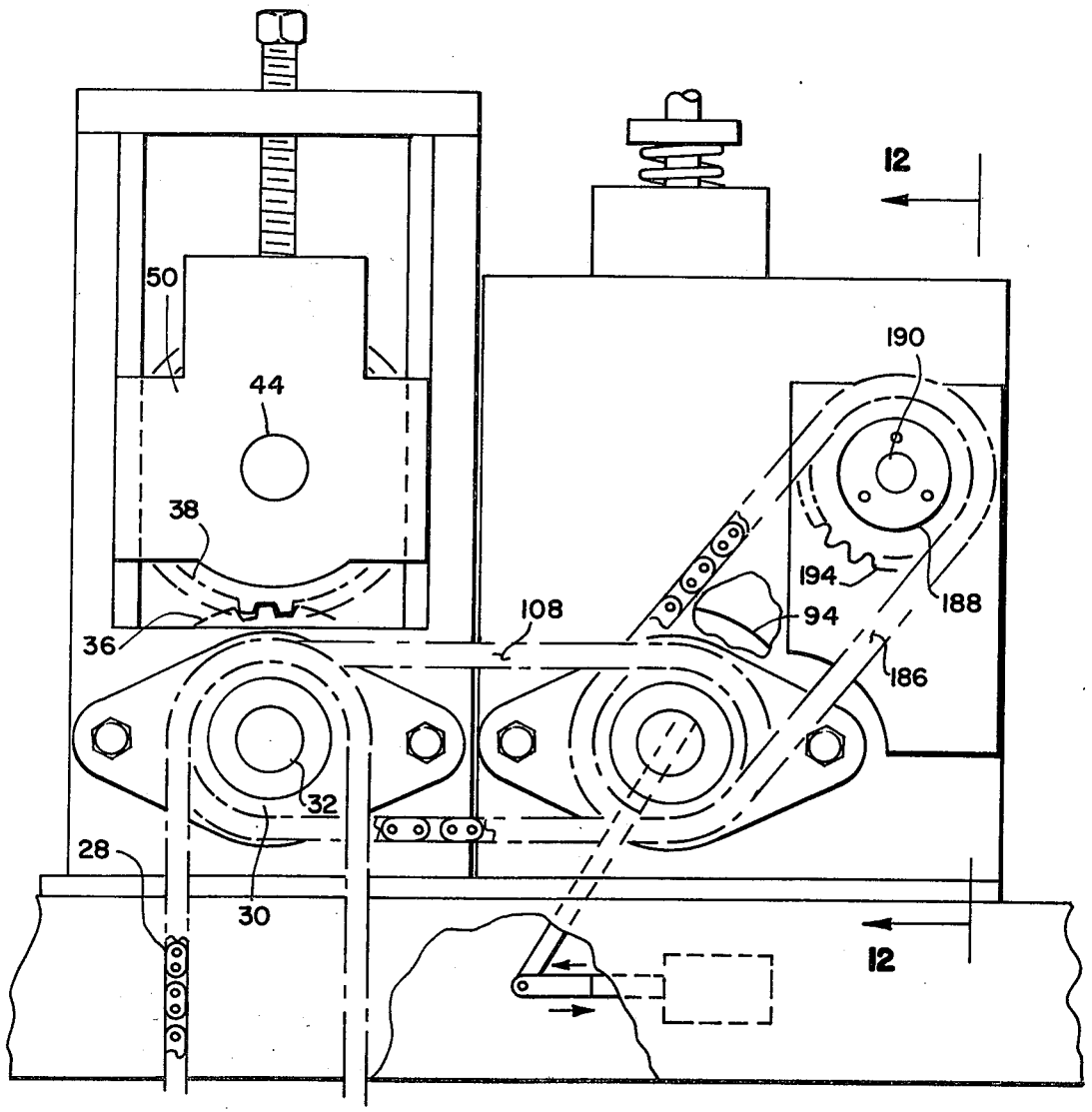
FIG. 11 is a view similar to FIG. 4 showing a modification of the invention.

As shown in FIG. 11, a drive chain 28 drives a sprocket 30 on a shaft 32 which carries one of the drive rollers 34 while intermeshing spur gears 36 and 38 on the respective shaft 32 and 44 coordinate unison rotary operation of the feed rollers 34 and 42 respectively such as shown in FIG. 1 of the drawings.

Figures 12, 14:
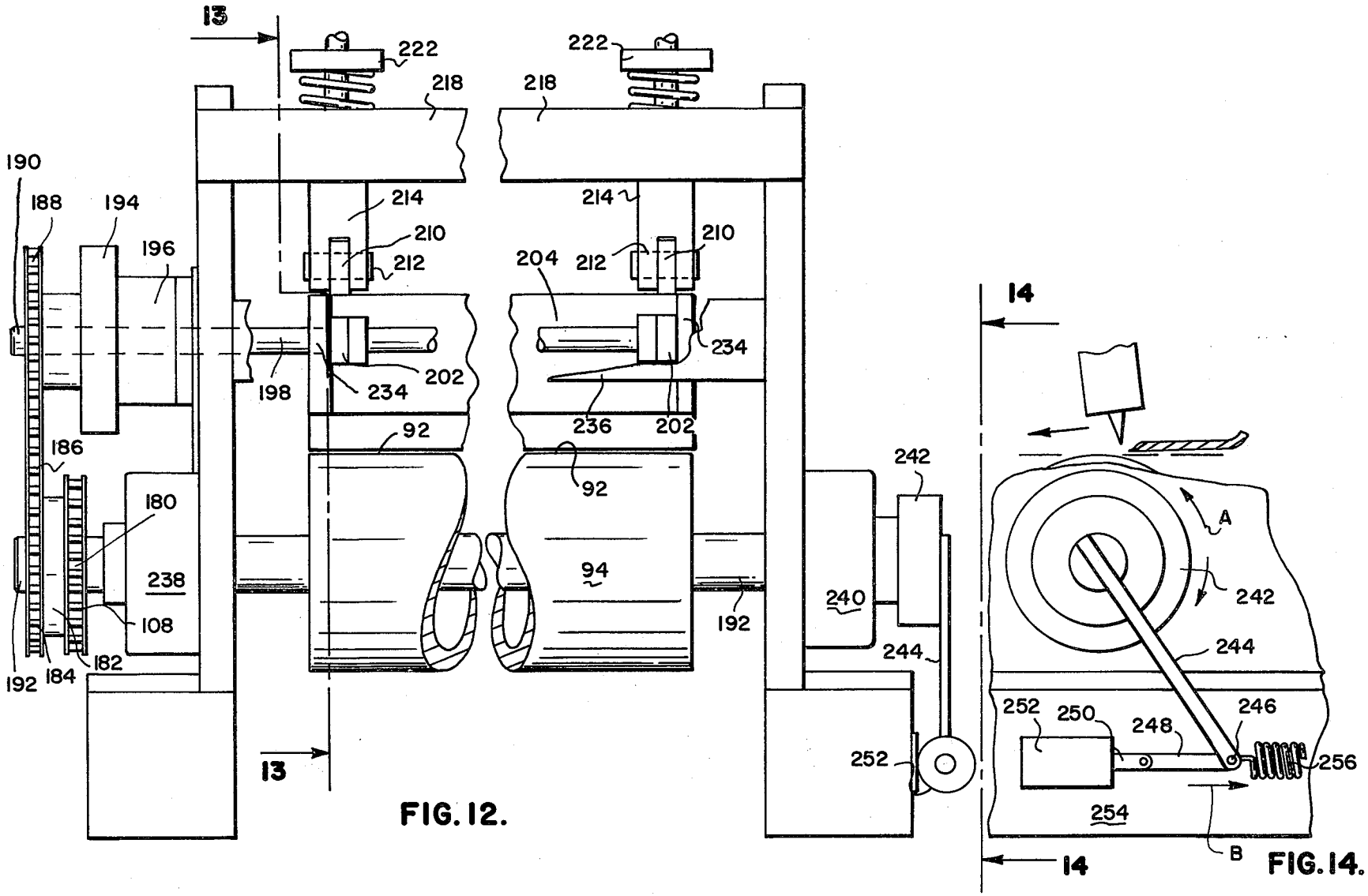
FIG. 12 is a view taken from the line 12—12 of FIG. 11.
FIG. 14 is fragmentary elevational view taken from the line 14—14 of FIG. 12 showing portions broken away and in section to amplify the illustration.

The chain 108 is engaged with a sprocket 110 such as shown in FIG. 2 of the drawings and this chain 108 passes over a sprocket 180 shown in FIG. 12 of the drawings. The sprocket 180 is mounted on the housing of a one-way overrunning clutch 182 shown in FIG. 12 of the drawings. This clutch is similar to that hereinbefore described in FIG. 9 of the drawings. Also mounted on the housing of the one-way clutch 182 is a sprocket 184 carrying a chain 186 which passes over a sprocket 188 on a shaft 190 all as shown best in FIG. 11 of the drawings.

The one-way or overrunning clutch 182 is adapted to drive a shaft 192 in a rotary direction of an arrow A in FIG. 13 of the drawings which is the same direction of rotation of the drive roller 34 and this overrunning clutch 182 is adapted to allow free rotation of the shaft 192 relative thereto in a direction opposite to the arrow A as will be hereinafter described in detail.

The shaft 190 operates a gear train transmission 194 which drives a single revolution clutch 196 such as a warner rotation control clutch CB-4. This single revolution clutch 196 operates a cam shaft 198 which is provided with eccentrics 200 as shown best in FIG. 13. These eccentrics 200 operating a pair of connecting rods 202 which are connected to a heat seal bar 204 by means of wrist pins 206 and respective wrist pin bearings 208 which are fixed to the heat seal bar 204. The heat seal bar 204 is provided with a pair of upwardly extending pivot bearing portions 210 which are pivotably mounted by means of pins 212 to a respective pair of plungers 214 which are reciprocally mounted in bore portions 216 of a frame cross member 218. An enlarged bore portion 220 directly above the bore portion 216 carries a compression spring 221 bearing against a threaded shoulder plate 222 which is locked by a threaded jam nut 224 and these members are secured on external threads of a reduced diameter shank portion 226 of the plunger 214. An upper end of the shank 226 is provided with a pivot 228 coupled to an armature 230 of an actuating solenoid 232.

The cam shaft 198 is supported in cam shaft bearings 234 supported on a horizontal member 236 of the machine frame.

The sealer roller 94 is carried by the shaft 192 in bearings 238 and 240 as shown in FIG. 12 of the drawings.

Adjacent the bearing 240 is an overrunning one-way clutch 242 which is also shown in FIG. 14 of the drawings. This clutch is adapted to engage and drive the shaft 192 in a rotational direction of the arrow A corresponding to the Arrow A in FIG. 13 and is adapted to allow the shaft 192 to overrun the clutch 242 in the opposite direction as will be hereinafter described.

Coupled to the housing of the clutch 242 is a lever arm 244 pivotably connected at 246 with a link 248 coupled to an armature 250 of a solenoid 252 which is mounted on a frame member 254 of the machine, all as shown best in FIG. 14.

Figure 13:
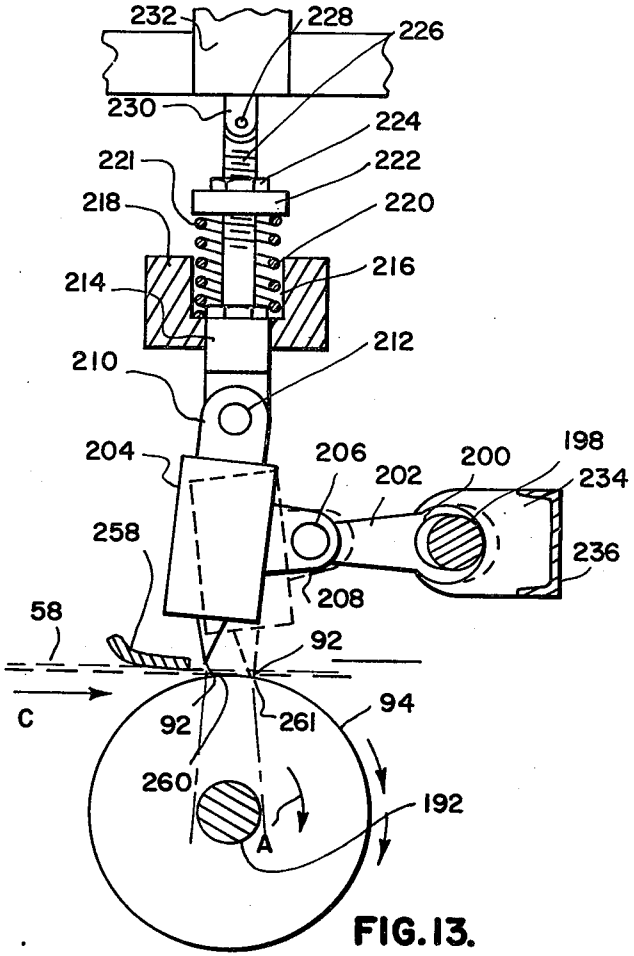
FIG. 13 is a sectional view taken from the line 13—13 of FIG. 12.

A return spring 256 is coupled to the pivot 246 and tends to pull the lever arm 244 in the direction of an arrow B as shown in FIG. 14 so as to actuate the housing of the clutch 242 in a direction of the arrow A and to rotationally drive the shaft 192 and sealer roller 94 in the direction of arrow A as shown in FIGS. 13 and 14.

Figure 10:
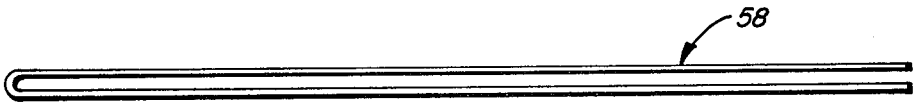
FIG. 10 is a cross-sectional view taken from the line 10—10 of FIG. 1 showing a cross-section of the folded plastic which passes through the machine for the manufacture of side weld plastic bags.

In operation the folded plastic 58 as shown in FIG. 10 of the drawings is fed between the drive rollers 34 and 42 in a direction of an arrow C in FIG. 13 beneath a stripper plate 258 and this plastic film is fed over the periphery of the sealer roller 94. The drive rollers 34 and 42 are rubber covered and adjustable for pressure as hereinbefore described so as frictionally to drive the plastic toward the sealer roller 94 which is generally of the same diameter as the drive rollers. The sealer roller is covered with silicone rubber and faced with a thin TEFLON tape. This teflon tends to minimize sticking of the plastic when it is heat sealed at the surface of the sealer roller.

A conventional cycling switch (not shown) is driven in unison with the drive rollers 34 and 42. This cycling switch is energized upon a rotary cycle of the rollers 34 and 32 whereby both the electrical solenoids 232 and the single revolution electrical clutch 196 and the solenoid 252 are all electrically energized whereby the heat seal bar 204 is actuated downwardly so as to bring the heat seal edge 92 of the heat seal bar into engagmenet with plastic as a location designated 260 in FIG. 13 of the drawings. Inasmuch as the periphery of the sealer roller 94 is moving constantly the single revolution clutch 196 driven through the gear train of the gear transmission 194 operates the cam shaft 198 causing it to rotate 180 degrees to move the edge 92 of the heat seal bar 204 from the position 260 to the position 261 shown in FIG. 13 while the periphery of the sealer roller 94 rotates exactly the same distance, it being understood that the gear ratio of the gear train in the gear box 194 is such that when it drives the single revolution clutch 196 the cam shaft 198 is rotated 180° at a rate such that the heat seal bar will move from the position 260 to the position 261 as shown in FIG. 13 while the periphery of the sealer roller 94 rotates exactly the same distance thus during the heat sealing of the plastic 58 the edge 92 of the heat seal bar 204 is maintained in exactly the same spot on the periphery of the heat seal roller 94 during its constant rotation. When the solenoids 232 and 252 are de-energized the spring 256 shown in FIG. 14 pulls the arm 244 backwardly in the direction of the arrow B rotating the overrunning one-way clutch 242 in the direction of the arrow A shown in FIG. 14 which is the same direction as the arrow A in FIG. 13 and due to the tension of the spring 256 this advances the rotation of the sealer roller 94 forward in its driven direction but more rapidly than it is normally driven in unison with the drive rollers 34 and 42 and consequently the plastic being held by these drive rollers 34 and 42 is held such that rapid advancement of the periphery of the heat seal roller 94 pulls away from the heat sealed edge 59 of the plastic 58 which tends to stick slightly to the surface of the heat seal roller and consequently the surface of the heat seal roller is pulled free of the sealed end 59 of the plastic 58 as shown in FIG. 6 by operation of the spring 256 acting on the lever 244 which rotates the one-way overrunning clutch 242 in a direction to drive the shaft 192 and the heat seal roller forward and in an advanced position relative to the drive rate of the drive rollers 34 and 42.

As the solenoids 232 are de-energized the heat seal bar moves upwardly and clears itself relative to the plastic and a stripper bar 258 holds the plastic down on the heat seal roller so that it may proceed freely to move into a position between the takeout rollers 172 and 174.

The relative stroke of the heat seal bar 204 at its edge 92 may be adjusted by means of the adjustable shoulder member 222 and the jam nut 224 which bears on the spring and regulates the relative elevation of the heat seal bar in accordance with its upper most position as shown in solid lines in FIG. 13 of the drawings. Thus the heat seal bar may be elevated to a position in which the plastic will not touch it as it passes to the periphery of the sealer roller 94. Additionally, the stripper bar 258 holds the plastic down to a level below the hot edge of the heat seal bar at 92 when the plastic is moving forward preliminary to a sealing operation by the heat seal bar. It will be understood that the warner single revolution clutch 196 is solenoid actuated so as to allow the clutch to perform its single revolution function each time the solenoid is energized. When the electrical signal is interrupted the sealer bar retracts and the warner single revolution clutch engages its stop as the sealer bar is returned to its original position.

Figure 9:
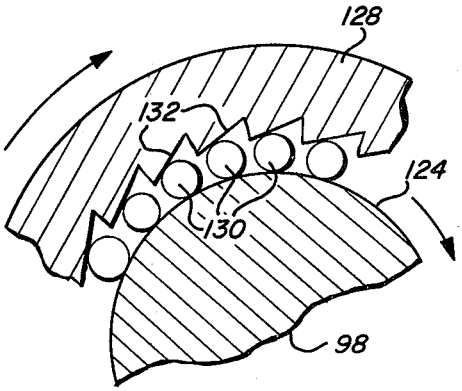
FIG. 9 is an enlarged fragementary sectional view taken from the line 9—9 of FIG. 7.

The sealer roller 94 driven by the chain 108 over the sprocket 180 is driven forward by means of the one-way overrunning clutch which is similar to that shown in FIG. 9 and it drives the shaft 192 and the sealer roller 94 in the forward direction of the arrow A in FIG. 13. Inasmuch as the one-way overrunning clutch 182 drives the shaft 192 in the direction of the arrow A the spring 256 driving the one-way clutch 242 in the same direction but at a higher rate allows the shaft 192 to overrun the clutch 182 momentarily as the periphery of the sealer roller 94 is advanced rapidly ahead of the driven rate of the shaft 192 and thus the sealer roller is allowed to move forward and pull free fo the sealed edge 59 of the plastic 58 in order to free the periphery of the roller from the sealed edge 59 and to prevent the plastic 58 from subsequently sticking to the roller 94 and winding therearound.

The aforementioned cycling switch is operable at each 360 degrees of rotation of the sealer roller and the length of the bags produced corresponds to the peripheral distance around the sealer roller which may be made especially for a given length of bag. Thus, the rollers 34 and 42 may be made in various diameters and changed as desired for making specific bags of specific lengths.

Figure 15:
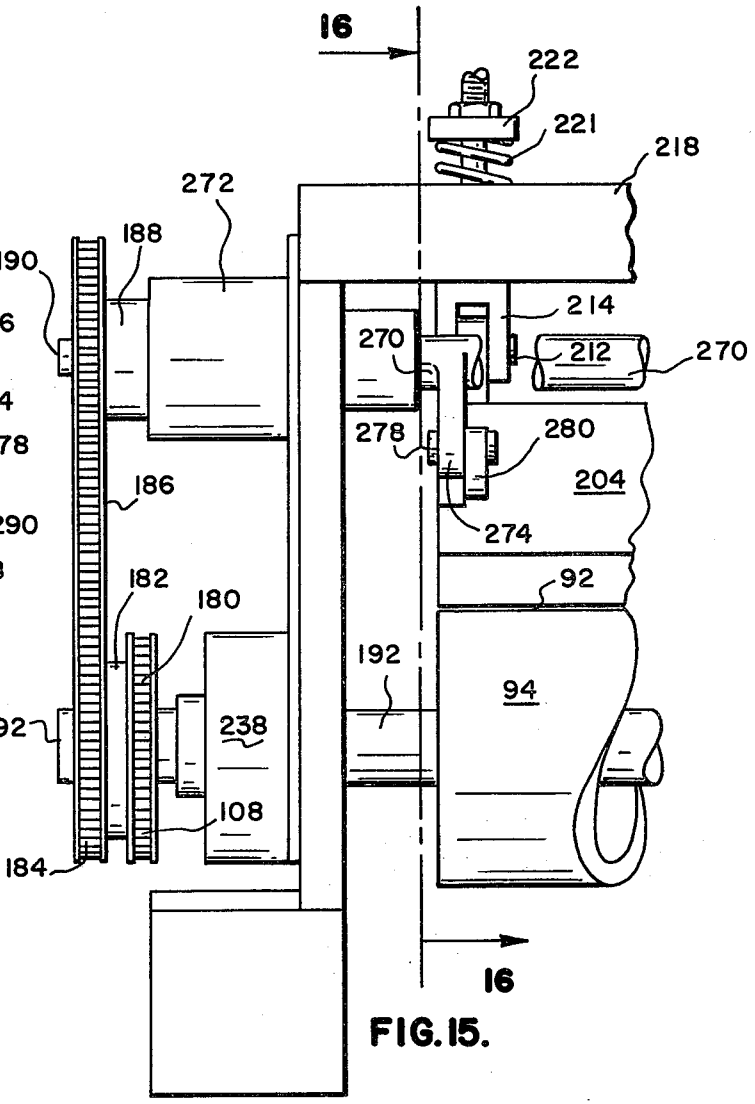
FIG. 15 is a view similar to FIG. 12 showing a further modification of the invention.
Figure 16:
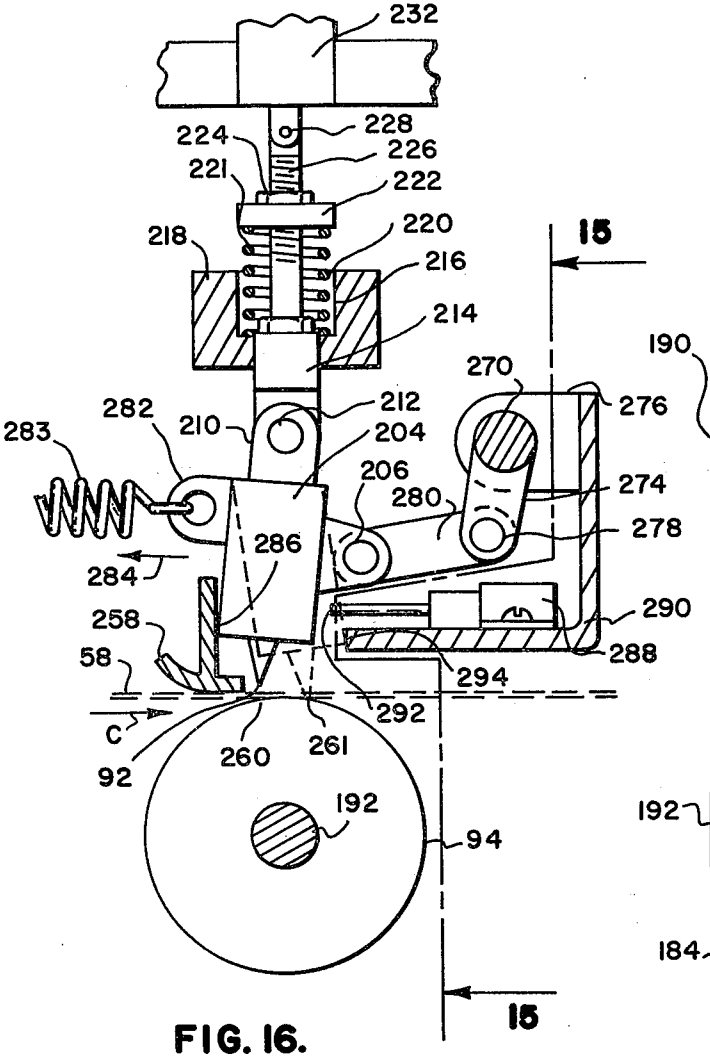
FIG. 16 is a fragmentary sectional view taken from the line 16—16 of FIG. 15.

In the modification as shwon in FIGS. 15 and 16, the shaft 190 is functional as a sealer bar actuating shaft and may be termed a first sealer bar actuating shaft. This shaft 190 is coupled to a second sealer bar operating shaft 270 by a magnetic clutch 272. This magnetic clutch 272 when energized couples the shafts 190 and 270 so that the shaft 190 rotates the shaft 270 for a short distance as will be hereinafter described.

Coupled to the shaft 270 is an arm 274 therebeing a plurality of these arms 274 throughout the length of the shaft 270 which is substantially coextensive with the sealer bar 204. Additionally, several bearings 276 support the shaft 270 in its coextensive relation with the sealer bar 204.

Thus, each arm 274 is provided with a pivot pin 278 connected to a linkage member 280 having its opposite end connected by means of a pivot pin to the sealer bar 204.

In opposition to the pin 206 and at the opposite side of sealer bar 204 is an eye structure 282 therebeing several of these eye structures along the sealer bar 204 as desired and these are engaged with respective springs 283 which are tension springs tending to force the sealer bar 204 in the direction of an arrow 284 as shown best in FIG. 16 of the drawings. Opposite ends of the springs 283 are stationarily mounted on the frame of the machine and these springs 283 tend to hold the sealer bar 204 against a stop member 286 which is stationarily mounted on the machine frame and integrel with the film guide 258 all as shown best in FIG. 16 of the drawings.

The stop 286 may be supported in stationary relationship with the machine in any suitable fashion as desired and it is not necessarily integrel with the film guide 258.

A microswitch 288 is mounted on a stationary bracket 290 which also supports the bearings 276 and this bracket 290 is rigidly connected to the frame of the machine.

The microswitch 288 is provided with a plunger having its extended end 292 in position to be engaged by an adjacent side of the sealer bar 204 when it moves to the broken line position to place the edge of the sealer bar at the location 261 shown in FIG. 16 of the drawings. The microswitch 288 may be adjustably mounted backward and forward toward the sealer bar 204 to a desired position so that the microswitch 288 may effectively de-energize the magnetic clutch 272 when the sealer bar 204 approaches an edge 294 of the bracket 290 which serves as a stop for the movement of the sealer bar 204 so that its movement is immediately limited after the microswitch plunger 292 has been engaged and has de-energized the magnetic clutch 272. Thus, the edge 92 of the sealer bar 204 engages plastic at 260 and disengages plastic at 261 at the surface of the sealer roller 94. The magnetic clutch 272 being de-energized at the same time that the spring 221 retracts the sealer bar 204 upward ashereinbefore described.

A digital incoder or pulse wheel (not shown) is driven in unison with the drive rollers 34 and 42 and the electrical pluses from the digital incoder are fed to an electronic counter. Each pulse represents a small increment of material length of the plastic 58 and the number of increments equal the draw length or width of the bag being made and thus the length of the bag is set up on the post counter and when adjusted will determine the overall length of the bag which is in a direction transverse to the folded plastic as shown in FIG. 10 of the drawings. When the desired number of increments set by the incoder is counted off on the pulse counter as it is driven in unison with the drive rollers provides an electrical output signal and immediately resets itself to repeat the operation. This occurs without stopping either the drive rollers or the sealer roller. The machine is designed to operate continuously without any intermittent starting or stopping of the drive or sealer rollers.

Upon the output of a signal from the pulse or digital counter three functions occur simultaneously. The solenoid 232, the magnetic clutch 272 and the solenoid 252 are all electrically energized. The solenoid 232 driving the sealer bar 204 downward to engage the plastic on the sealer roller at the location 260. The electrical or magnetic clutch 272 causes the shaft 190 to be coupled to the shaft 270 driving it in a rotational direction a small distance actuating the linkage arm 280 and moving the sealer bar edge 92 to the position 261 in unison with the peripheral movement of the sealer roller 94. The function of the solenoid 252 as shown in FIG. 14 takes place in connection with the modification or modified structure shown in FIG. 15 and 16 and the hereinbefore described functions of this solenoid 252 when energized as hereinbefore described stores energy in the spring 256 to be ready to advance the sealer roller as hereinbefore described.

When the sealer bar completes i8ts stroke to a position against the plunger 292 of the limits switch 288. This switch is open and de-energizes the magnetic clutch 272, the solenoids 232 and the solenoid 252. Accordingly, the sealer bar rises from its position upwardly and it is moved backward by the springs 283 against the stop 286 into the solid line position as shown in FIG. 16 while the springs 221 concurrently raise the sealer bar 204 and the spring 256 automatically moves the overrunning clutch in the direction of the Arrow A and rapidly advances the sealer roller so that the roller is pulled away from the previously heat sealed edged of the plastic to prevent the plastic from sticking to the sealer roller 94 and being rapped there around as hereinbefore described in connection with the structures shown in FIGS. 12 and 14 of the drawings.

It will be obvious to those skilled in the art that various modifications of the invention may be resorted to without departing from the spirit of the invention.

We claim:

1. In a plastic bag manufacturing machine; a frame; a pair of drive rollers rotatably mounted on said frame and adapted to engage folded plastic therebetween; power operated means for rotating said drive rollers; a sealer roller mounted on said frame in position to receive said folded plastic from said drive rollers; a heated sealer bar rotatably mounted on said frame and axially parallel to said sealer roller; said sealer bar having a radially projecting sealer edge portion adapted to rotate into close proximity to said sealer roller for sealingly engaging said folded plastic on said sealer roller; first means for rotating said sealer roller; second means for rotating said sealer bar such that adjacent portions of said sealer roller and said sealing edge of said sealing bar move in the same direction at a common rate; said second means also having auxillary means adapted to rotate said sealer bar at a higher rate than that of said drive rollers and said sealer rollers; a one-way clutch coupled to said sealer roller; an advancing member coupled to said sealer bar and disposed to engage and drive said one-way clutch for several degrees during each revolution of said sealer bar whereby said one-way clutch momentarily advances said sealer roller rotationally at a rate comparable to that of said sealer bar when said sealer bar is rotated at said higher rates by said auxillary means; said first means, which drives said sealer roller, having a lost motion drive mechanism allowing said sealer roller to be rotationally advanced at said higher rate during operation of said one-way clutch for several degrees of rotation; said second means having intermittently operated clutch means disposed and adapted to operate said auxillary means to thereby rotate said sealer bar intermittently; said second means adapted to rotate said sealer roller at a rotational rate common to that of said drive rollers and adapted to operate said heat seal bar at said common rotational rate until said sealing edge thereof has engaged and sealed plastic on the surface of said sealer roller and then said auxillary means is adapted to rapidly advance the rotational rate of said sealer bar to thereby also cause said advancing member to actuate said one-way clutch and to concurrently rotate said sealer roller at said higher rate whereby a heat sealed plastic bag is separated and removed away from the remaining plastic being fed toward said sealer roller by said drive rollers.

2. The invention as defined in claim 1 wherein; said second means is provided with a barke disposed to stop rotation of said sealer bar at a predetermined position at the end of each revolution thereof.

3. The invention as defined in claim 2 wherein: said second means is provided with a jack shaft rotatably mounted on said frame; ratio changing drive means driven by said power operated means; said ratio changing drive means disposed to rotate said jack shaft; said jack shaft coupled to said sealing bar for driving the same; said brake operated to stop and start said jack shaft; said intermittently operable means disposed and adapted to intermittently actuate said ratio changing drive means in timed relation to operation of said brake.

4. The invention as defined in claim 3 wherein: said clutch means is provided with first and second clutches; different ratio gears coupled to said first and second clutches whereby alternate operation of said first and second clutches operate said jack shaft at different ratios such that one of said clutches operates said heat sealing bar rotationally at said common rate and whereby another one of said clutches operates a respective ratio gear to rotate said heat seal bar at said higher rate.

5. The invention as defined in claim 1 wherein: said one-way clutch is provided with resilient return means tending to rotationally return said one-way clutch, in a direction opposite to that caused by said advancing member, to a starting position; and stop means carried by said frame and cooperable with said one-way clutch to stop said one-way clutch in said starting position ready to again be engaged and driven by said advancing member of said sealer bar.

6. The invention as defined in claim 5 wherein: said first and second means are coupled to and driven by said power operated means for coordinating operation of said drive rollers, said sealer roller, and said sealer bar.

7. The invention as defined in claim 1 wherein: said sealer roller is provided with a shaft portion; said first means having a rotary drive member rotatably mounted on said shaft portion; said first means also having a fixed drive member fixed to said shaft portion; and lost motion means disposed to allow limited lost rotary motion between said rotary drive member and said fixed drive member.

8. The invention as defined in claim 1 wherein: said second means is provided with a brake to stop rotation of said sealer bar at a predetermined position at the end of each revolution thereof; said one-way clutch having resilient return means tending to rotationally return said one-way clutch in a direction opposite to that caused by said advancing member to a starting position; and stop means carried by said frame and cooperable with said one-way clutch to stop said one-way clutch in said starting position ready to again be engaged and driven by said advancing member of said sealer bar; said sealer roller having a shaft portion; said first means having a rotary drive member rotatably mounted on said shaft portion; said first means also having a fixed drive member fixed to said shaft portion; and lost motion means disposed to allow limited lost rotary motion between said rotary drive member and said fixed drive member; and said second means having transmission mechanism including a one-to-one drive ratio and a higher rate drive ratio for respectively rotating said heat seal roller and said heat seal bar at said common rate and for rotating said heat seal bar at said higher rate.

9. In a plastic bag manufacturing machine; a frame; a pair of drive rollers rotatably mounted on said frame and adapted to engage folded plastic therebetween; power operated means for rotating said drive rollers; a sealer roller mounted on said frame in position to receive said folded plastic from said drive rollers; a heated sealer bar moveably mounted on said frame axially parallel to said sealer roller; said sealer bar having a projecting sealer edge portion adapted to move into close proximity to said sealer roller to sealingly engage said folded plastic on said sealer roller; first means for rotating said sealer roller; second means for moving said sealer bar such that adjacent portions of said sealer roller and said sealing edge of said sealer bar move in the same direction at a common rate for engaging plastic between said sealer roller and sealer bar edge to form a seal; and means adapted momentarily to move said sealer bar and said sealer roller a few degrees at a higher rate than that of said drive rollers for separating said plastic at a location of said seal bar edge and moving said sealer roller a short distance relative to the remaining plastic being fed in a direction toward said sealer roller by said drive rollers.

10. In a plastic bag manufacturing machine: a frame; a pair of drive rollers rotatably mounted on said frame and adapted to engage folded plastic therebetween; power operated means for rotating said drive rollers; a sealer roller mounted on said frame in position to receive said folded plastic from said drive rollers; a heated sealer bar movably mounted on said frame and axially parallel to said sealer roller; said sealer bar having a projecting sealer edge portion adapted to move into close proximity to said sealer roller for sealingly engaging said folded plastic on said sealer roller; first means for rotating said sealer roller; second means for moving said sealer bar against said sealer roller and such that adjacent portions of said sealer roller and said sealing edge of said sealing bar move in the same direction and at the same rate for a short distance; intermittent means for rapidly rotatably advancing the periphery of said sealer roller in the direction of movement of said plastic and at a rate greater than that at which said drive rollers drive said plastic whereby said periphery of said sealer roller is pulled loose from a welded edge of said plastic which tends to stick to said sealer roller and whereby said plastic is prevented from sticking to said sealer roller and subsequently wrapping therearound; a first overrunning clutch for driving said sealer roller in connection with said drive rollers; an actuating shaft driven in unison with said sealer roller; eccentric means mounted on said actuating shaft for moving said sealer bar at a rate comparable to the peripheral travel of said sealer roller; first actuating means for moving said sealer bar into contact with plastic on said sealer roller concurrently with the operation of said actuating shaft; a second overrunning clutch coupled to said sealer roller; second actuating means for actuating said second overrunning clutch in a direction which allows the clutch to overrun the rate of said drive rollers and a spring for returning said last mentioned overrunning clutch and for driving said sealer roller in a direction in which said plastic is driven by said drive rollers but at said greater rate so as to pull the periphery of said sealer roller free from the welded edge of said plastic which travels at the same rate as said drive rollers.

11. In a plastic bag manufacturing machine; a frame; a pair of drive rollers rotatably mounted on said frame and adapted to engage folded plastic therebetween; power operated means for rotating said drive rollers; a sealer roller mounted on said frame in position to receive said folded plastic from said drive rollers; a heated sealer bar movably mounted on said frame and axially parallel to said sealer roller; said sealer bar having a projecting sealer edge portion adapted to move into close proximity to said sealer roller for sealingly engaging said folded plastic on said sealer roller; first means for rotating said sealer roller; second means for moving said sealer bar against said sealer roller and such that adjacent portions of said sealer roller and said sealing edge of said sealing bar move in the same direction and at the same rate for a short distance; and intermittent means for rapidly rotatably advancing the periphery of said sealer roller in the direction of movement of said plastic and at a rate greater than that at which said drive rollers drive said plastic whereby said periphery of said sealer roller is pulled loose from a welded edge of said plastic which tends to stick to said sealer roller and whereby said plastic is prevented from sticking to said sealer roller and subsequently wrapping therearound; said second means comprises a first sealer bar actuating shaft; said first sealer bar actuating shaft being rotatably coupled to said sealer roller; a magnetic clutch; a second sealer bar actuating shaft; said magnetic clutch disposed to couple and uncouple said first and second sealer bar actuating shafts; linkage means pivotally coupling said sealer bar and said second sealer bar actuating shaft; said sealer bar pivotally mounted to pivot on an axis substantially parallel to said sealer roller; resilient means tending to pivotally urge said sealer bar in a direction laterally relative to said sealer roller; stop means disposed to limit the pivotal movement of said sealer bar by said resilient means; and limit switch means disposed to be actuated by a movement of said sealer bar, by said linkage means, in a direction opposite to that urged by said resilient means; said limit switch means adapted to de-energize said magnetic clutch when actuated by pivotal movement of said sealer bar.

* * * * *